US011527397B2

(12) United States Patent
Bookmeyer et al.

(10) Patent No.: US 11,527,397 B2
(45) Date of Patent: Dec. 13, 2022

(54) DESORPTION ION SOURCE WITH DOPANT-GAS ASSISTED IONIZATION

(71) Applicant: Bruker Daltonics GmbH & Co. KG, Bremen (DE)

(72) Inventors: Christoph Hauke Manfred Bookmeyer, Münster (DE); Jens Soltwisch, Herten Westf (DE); Klaus Dreisewerd, Münster (DE)

( * ) Notice: Subject to any disclaimer, the term of this patent is extended or adjusted under 35 U.S.C. 154(b) by 0 days.

(21) Appl. No.: 17/392,592

(22) Filed: Aug. 3, 2021

(65) Prior Publication Data

US 2022/0037142 A1 Feb. 3, 2022

(30) Foreign Application Priority Data

Aug. 3, 2020 (DE) ..... 102020120394.2

(51) Int. Cl.

| | |
|---|---|
| ***H01J 49/16*** | (2006.01) |
| ***H01J 49/24*** | (2006.01) |
| ***H01J 49/00*** | (2006.01) |
| ***H01J 49/04*** | (2006.01) |

(52) U.S. Cl.

CPC ..... *H01J 49/164* (2013.01); *H01J 49/0027* (2013.01); *H01J 49/24* (2013.01); *H01J 49/0418* (2013.01)

(58) Field of Classification Search

CPC ..... H01J 49/164; H01J 49/0027; H01J 49/24; H01J 49/0418

See application file for complete search history.

(56) References Cited

U.S. PATENT DOCUMENTS

2011/0049352 A1 3/2011 Ding et al.
2013/0026359 A1 1/2013 Kumashiro et al.

FOREIGN PATENT DOCUMENTS

JP H1114571 A 1/1999

OTHER PUBLICATIONS

Brockmann et al., Presentation at the OurCon VII conference, St. Malo, France, Oct. 28-31, 2019.
Soltwisch et al., Presentation at the 22nd International Mass Spectrometry Conference, Florence, Italy, Aug. 26-31, 2018.
Bookmeyer et al., Poster presentation at the 52nd Annual Conference of the German Society for Mass Spectrometry (DGMS), Rostock, Germany, Mar. 10-13, 2019.

(Continued)

*Primary Examiner* — Nicole M Ippolito
*Assistant Examiner* — Hanway Chang
(74) *Attorney, Agent, or Firm* — Benoit & Côté Inc.

(57) ABSTRACT

Disclosed is a device to generate ions from a deposited sample, comprising: A chamber which is arranged and designed to keep the deposited sample in a conditioned environment comprising a dopant gas, A desorption device which is arranged and designed to desorb the deposited sample in the chamber using an energy burst, An ionization device which, for the purpose of ionization, is arranged and designed to irradiate the desorbed sample in the chamber using coherent electromagnetic waves or expose it to an electric discharge, a plasma, or light of an arc discharge lamp with broadband emission spectrum, which are chosen such that the dopant gas is receptive to them, and An extraction device which is arranged and designed to extract ions from the desorbed sample and transfer them into an analyzer. Disclosed is also a method which is preferably conducted on such a device.

16 Claims, 5 Drawing Sheets

(56) References Cited

OTHER PUBLICATIONS

Bookmeyer et al., Presentation at the 67th Annual Conference of the American Society for Mass Spectrometry (ASMS), Atlanta, GA, USA, Jun. 2-6, 2019.
W. Chen et al., "Dopant-assisted reactive low temperature plasma probe for sensitive and specific detection of explosives ", Analyst, 2015, 140, 6025.
M. Niehaus et al., "Transmission-mode MALDI-2 mass spectrometry imaging of cells and tissues at subcellular resolution", Nature Methods, vol. 16, pp. 925 to 931 (2019).
Soltwisch et al. "Mass spectrometry imaging with laser-induced postionization", Science, Vo. 348, Issue 6231, Apr. 2015.

DESORPTION ION SOURCE WITH DOPANT-GAS ASSISTED IONIZATION

BACKGROUND OF THE INVENTION

Field of the Invention

The invention relates to a device to generate ions from a deposited sample, particularly for analytical systems (e.g., mobility spectrometers, mass spectrometers, and combined mobility-mass spectrometers) and applications for the further analysis of the ions generated.

Description of the Related Art

The related art is explained in this introduction with reference to a specific aspect. However, this should not be understood as limiting the following disclosure of the invention. Useful developments and modifications from that which is known in the related art may also be applicable beyond the comparatively narrow scope of this introduction and will be readily apparent to skilled practitioners in the field after reading the disclosure of the invention following this introduction.

Laser mass spectrometry is a detection method with a wide variety of uses in chemical, biochemical, and biomedical analysis. As is well documented in the literature and diverse application examples, laser desorption/ionization mass spectrometry (LDI MS) methods can be used to detect biomolecules, in particular, from a large range of classes of molecule (such as peptides, lipids, oligosaccharides) without the need for labeling. The detection of pharmaceutical substances and technical polymers, for example, is also often carried out by means of LDI MS, which shall be explained in more detail here using the example of matrix-assisted LDI MS (MALDI MS).

A particularly important application of MALDI (amongst others) is the spatially resolved detection of biomolecules (or pharmaceutical substances) from tissue sections. Imaging MALDI Mass Spectrometry is often called MALDI MSI (for MS Imaging). The limited amounts of sample per irradiated pixel mean that high sensitivity is particularly important in MALDI MS.

To enhance the yields of ionized molecules, i.e., to provide a charge to as many as possible of the biomolecules ablated by means of the laser, a research group at the Westfälische Wilhelms University in Münster, Germany, introduced the so-called MALDI-2 method (or MALDI with laser-induced post-ionization) in 2015 (Soltwisch et al., Science 348, 211-215). In MALDI-2, secondary MALDI-like ionization processes in the gaseous phase (i.e., in a specially designed ion source which is operated at a residual gas pressure of a few hectopascal in nitrogen) are initiated by a second laser beam. This makes it possible to improve the detection limits of high-resolution imaging mass spectrometry for a large number of important biomolecules (in particular phospholipids and glycolipids, sterols, glycans, secondary metabolites, fat-soluble vitamins) by two orders of magnitude or more.

Meanwhile, laser-based MALDI-2 ion sources have been successfully established on the ion sources of hybrid mass spectrometers from three manufacturers: Synapt G2-S (Waters/Micromass, Manchester, UK), Orbitrap® (Thermo Fisher Scientific, Bremen, Germany, with dual ion-funnel sources from Spectroglyph, Kennewick, Wash., USA), and timsTOF fleX (Bruker Daltonics GmbH & Co. KG, Bremen, Germany).

It has been shown that, in some cases, laser-based post-ionization is also possible by matrix-free desorption, e.g., by using an infrared laser (Brockmann et al., presentation at the OurCon VII conference, St. Malo, France, Oct. 28-31, 2019).

In further studies undertaken by the Münster research group, other (post-) ionization modules were successfully tested, particularly those using a dielectrically constrained plasma in combination with MALDI MSI (Soltwisch et al., presentation at the 22nd International Mass Spectrometry Conference, Florence, Italy, Aug. 26-31, 2018). Moreover, it was possible to bring about ionization in the gaseous phase by means of initial excitation of the material cloud of a sample that was degassed without laser desorption. This initial excitation was produced by means of high-energy photons from krypton discharge lamps, which emit light just below 124 nanometers (one line at 123.9 nanometers, ~80%, and one line at 116.9 nanometers, ~20%), and therefore achieve single-photon ionization of molecules in the gaseous phase (Bookmeyer et al., poster presentation at the 52nd Annual Conference of the German Society for Mass Spectrometry (DGMS), Rostock, Germany, Mar. 10-13, 2019).

A further recent study demonstrated the combination of MALDI-MSI and this technique called *Single-Photon Induced Chemical Ionization* (SPICI) (Bookmeyer et al., presentation at the 67th Annual Conference of the American Society for Mass Spectrometry (ASMS), Atlanta, Ga., USA, Jun. 2-6, 2019). The high-energy vacuum ultraviolet (VUV) photons were directed from three krypton discharge lamps onto the ablation site over a wide solid angle. These experiments, which were performed on a Spectroglyph-Orbitrap® combination, achieved improvements for imaging MALDI MS of a similar order of magnitude to those for MALDI-2 with pulsed UV post-ionization lasers.

It was possible to significantly improve the ion yields generated by SPICI, both for volatile organic compounds (VOC) and semi-volatile compounds (sVOC), and for laser-desorbed molecules, by introducing a dopant gas (e.g. acetone, toluene, anisole, chlorobenzene, isopropanol). These dopants are known from atmospheric pressure photoionization (APPI), also in combination with a preceding laser desorption, see US 2011/0049352 A1. Photons with around ten electronvolts, as are generated in krypton discharge lamps, already have sufficient energy for single-photon ionization of these types of dopants. Dopants for signal improvement have also already been demonstrated in studies on plasma-based ionization, for example (W. Chen et al., Analyst, 2015, 140, 6025).

It is, moreover, known from secondary ion mass spectrometry (SIMS), in which a primary ion beam is directed at a deposited sample and the impact generates sputtered secondary ions, which are then analyzed, that sputtered neutral atoms and molecules can be post-ionized by means of a laser beam to increase the ionization yield, see for example JP H1114571 A (Hitachi). The photons of the post-ionization laser beam act directly on the sputtered neutral atoms and molecules, however. Furthermore, SIMS requires a high-vacuum environment ($<10^{-3}$ hectopascal).

Even though it is already possible to achieve significantly improved detection limits by means of post-ionization in a MALDI-2 experiment, a laser-SIMS setup, or by means of MALDI-SPICI, it is still likely that for many classes of molecule, only a fraction of the ablated material is actually ionized and can thus be detected.

There is therefore a need for a substantial further sensitivity increase for LDI MS and LDI MSI, for example by means of MALDI-2 MSI, as well as further post-ionization methods. Further objectives that can be achieved by the invention will be immediately clear to the person skilled in the art from reading the disclosure below.

SUMMARY OF THE INVENTION

According to a first aspect, the disclosure relates to a device to generate ions from a deposited sample, comprising: A chamber which is arranged and designed to keep the deposited sample in a conditioned environment (particularly at a pressure higher than high vacuum, $10^{-3}$ hectopascal, e.g., medium vacuum through to atmospheric pressure), where the conditioned environment comprises a dopant gas, A desorption device which is arranged and designed to desorb the deposited sample in the chamber using an energy burst, An ionization device which, for the purpose of ionization, is arranged and designed to irradiate the desorbed sample in the chamber using coherent electromagnetic waves, which are chosen such that the dopant is receptive to them, in particular to bring about the ionization via photochemical excitation of the dopant gas molecules and subsequent charge carrier transfer to desorbed sample molecules, and A (voltage-assisted) extraction device which is arranged and designed to extract ions from the desorbed sample and transfer them into an analyzer.

The analyzer can be a mobility analyzer, mass analyzer, or combined mobility-mass analyzer, which is connected to the device either directly or indirectly via interposed ion guides. Possible mass analyzers are, for example, time-of-flight analyzers (with axial or orthogonal injection, and with linear or reflector-reversed flight path), quadrupole filters, quadrupole ion traps (2D or 3D), cyclotron resonance analyzers, or analyzers of the Kingdon type, such as the Orbitrap®. Possible mobility analyzers are, for example, drift tube analyzers with linear DC voltage gradient with (largely) stationary gas, traveling-wave ion mobility analyzers ("TWIMS") from Waters Corporation, or trapped ion mobility analyzers ("TIMS") from Bruker Daltonics GmbH & Co. KG.

The deposited sample can be a flat sample such as a thin tissue section, whose molecular content is measured with spatial resolution in order to compile a distribution map of molecules of interest, e.g., biomolecules such as peptides, lipids (phospholipids and glycolipids), oligosaccharides, sterols, glycans, secondary metabolites, or fat-soluble vitamins, but also other, possibly non-tissue molecules such as active medicinal agents (pharmaceutical substances). It is also possible to analyze isolated samples or preparations, as are prepared on the AnchorChip plates known from MALDI, for example.

In various embodiments, the dopant gas can be selected from the groups: (i) polar aprotic solvents such as acetone, anisole, and chlorobenzene, (ii) polar protic solvents such as isopropanol, and/or (iii) non-polar solvents such as toluene. The dopant on which the dopant gas is based is preferably volatile under the chosen pressure conditions, e.g., in medium vacuum or at/close to atmospheric pressure. The dopant gas can be produced by extracting the vapor (gaseous phase) over a surface of the dopant in the liquid state from a container and introducing it into the conditioned environment, preferably through heated pipes, e.g., by means of a syringe plunger, or it can diffuse there by following a concentration gradient.

A photochemical excitation of the dopant gas could take place, for example, by an initial single-photon excitation in the form of an $n \rightarrow \pi^*$ transition of a carbonyl group, e.g., with acetone, whose UV absorption spectrum has a maximum at around 270 nanometers, which is then followed indirectly by ionization as a result of processes that are still unclear. This would distinguish the ionization processes with electromagnetic waves according to the disclosure from single-photon ionization processes, where the absorption of one photon leads directly to an excess charge on the molecule, as is the case with very high-energy light of the emission lines of krypton discharge lamps (wavelength<124 nanometers), for example.

The combination of a post-ionization method, such as irradiation of the desorbed sample with coherent electromagnetic waves (e.g., with pulsed intensive laser radiation, as with MALDI-2), and a chemical dopant gas introduced in gaseous form into a desorption ion source leads to the excitation of the dopant gas by the post-ionization method so that additional charge carriers are available for ionization of the neutral molecules in the desorbed sample. These can then be transferred to the analyte molecules in addition to any already existing charge carriers (e.g., protonated matrix molecules in the case of MALDI desorption) and thus lead to a signal enhancement. It is preferable for the (coherent) electromagnetic waves to have a wavelength beyond the VUV range (~5 to 190 nanometers) so that no single-photon ionization of the dopant gas takes place; the wavelength is preferably greater than 140 nanometers, for example 266 nanometers, as can be generated by frequency quadrupling of an original near-infrared wavelength of 1064 nanometers.

In various embodiments, the chamber can have a feed-in device which is arranged and designed to feed in a gas with low reactivity, such as molecular nitrogen $N_2$, as buffer gas for the conditioned environment. Fundamentally, the chamber can be maintained at or close to atmospheric pressure. The feed-in device is preferably arranged and designed to admix the dopant gas to the buffer gas. The admixing can take place before it enters the chamber so that a mixture of buffer gas and dopant gas enters, or via a separate feed-in so that the mixture of buffer gas and dopant gas is only created in the chamber. In both cases, the appropriate gas pipes can be (moderately) heated to make it difficult for condensation and/or resublimation to occur, or to prevent it completely.

In various embodiments, the chamber can be connected to a vacuum source to evacuate the environment of the deposited sample. The vacuum source can be arranged and designed to maintain a pressure that is substantially higher than a high vacuum ($>10^{-3}$ hectopascal) and lower than around $10^2$ hectopascal. An ion source operated in this pressure range can be coupled very easily and efficiently, especially in relation to the ion transfer, with a mobility analyzer, which operates well in a similar pressure regime. A partial pressure of the dopant gas in relation to the total pressure can be between 0.2% and 50%, in particular between 2% and 20%, for example two hectopascal dopant gas partial pressure in relation to twenty hectopascal total pressure, or two hectopascal dopant gas partial pressure in relation to four hectopascal total pressure. Depending on the arrangement in the ion source, the dopant gas partial pressure can also exceed these limits, however.

In various embodiments, the desorption device can be arranged and designed to direct an energetic beam onto the deposited sample to trigger the energy burst. The energetic beam is preferably a pulsed laser beam to ablate the deposited sample. Preparation of the sample with a MALDI matrix substance is beneficial here because it promotes ablation through its absorption characteristics, particularly in the ultraviolet spectral range (e.g., at 349 nanometer wavelength). Examples for UV-responsive MALDI sample substances are 2,5-dihydroxyacetophenone (DHAP), 2,5-dihydroxybenzoic acid (DHB), α-cyano-4-hydroxycinnamic acid (HCCA), or sinapic acid (SA). The pulsed desorption laser beam has a wavelength which is preferably longer than the wavelength of the (coherent) electromagnetic waves for the photochemical excitation, which leads to ionization. It is furthermore preferable for the coherent electromagnetic waves, for example of a MALDI-2 laser, to have a wavelength that is below a two-photon ionization threshold of UV-responsive MALDI matrix molecules (<around 310 nanometers). In addition to the MALDI principle, it is also conceivable to ablate a matrix-free sample (e.g., by means of LDI). The energetic beam and the (coherent) electromagnetic waves are preferably not aligned in parallel, but have directions of propagation which are at an angle with respect to each other. The angle can be 45° or more, where an angle of 0° corresponds to the same direction and 180° to the opposite frontal direction.

The sample which is usually deposited (possibly prepared) on a specimen slide, can receive the energetic beam on the sample side or from the side of the specimen slide which faces away from the sample side, passing through the specimen slide (in transmission), for example via transmission MALDI or t-MALDI, see in particular M. Niehaus et al., Nature Methods, Volume 16, pages 925 to 931 (2019). It shall be understood that the action of an energetic beam in transmission requires the specimen slide to be appropriately transparent. Other types of energy burst which can act on the deposited sample for the purpose of desorption are, for example, brief and localized heating, e.g., on a resistance-heated substrate, or acoustic waves with ultrashort pulse duration, e.g., on an acoustic transducer substrate.

In various embodiments, the ionization device can be arranged and designed to irradiate the desorbed sample with a pulse of (coherent) electromagnetic waves temporally coordinated with the energy burst. For this purpose, the ionization device can comprise a laser which emits pulses of coherent electromagnetic waves with pulse durations in the picosecond or nanosecond range. This enables excitation of the dopant gas to increase the number of charge carriers available in precisely the periods in which neutral molecules, together with any molecules already ionized in the desorption process itself (such as with MALDI), propagate in the conditioned environment, having been driven away from the desorption site by the energy burst. It is preferable for the buffer gas and the admixing of the dopant gas to form an omnipresent gas background in the chamber, which considerably simplifies the operation and control of the gas feed-in. In further alternatives, if the clock-pulse rate of the energy bursts permit, it is also possible for pulses of the dopant to be injected into the chamber, in temporal coordination with the desorption energy bursts onto the deposited sample and with the pulses of the (coherent) electromagnetic waves, which afterwards irradiate the desorbed sample (or other post-ionization methods, such as electric discharge, plasma, or light of an arc discharge lamp with a broad emission spectrum) in order to increase the number of available excited dopant gas molecules locally and briefly, where and when required.

In various embodiments, the extraction device at an interface to an ion analysis device can comprise an arrangement of electrodes to which voltages can be applied to extract ions from the desorbed sample and transfer them into the segment of the analytical device, which can be operated under pressure conditions which are different to those in the chamber, e.g., in high vacuum ($<10^{-3}$ hectopascal). The voltages can, for example, generate a permanent potential gradient, which accelerates ions, or it can be applied as a pulse in temporal coordination with ion generation. Pulsewise application of the voltage provides high flexibility, e.g., for a change in polarity of the ions generated.

According to a second aspect, the disclosure also relates to a device to generate ions from a deposited sample, comprising: A chamber which is arranged and designed to keep the deposited sample in a conditioned environment, and the conditioned environment comprises a dopant gas, A desorption device which is arranged and designed to desorb the deposited sample in the chamber using an energy burst, An ionization device which, for the purpose of ionization, is arranged and designed to expose the desorbed sample in the chamber to an electric discharge, a plasma or (possibly pulsed) light of an arc discharge lamp with intensive broadband photon emission (e.g., a UV flash tube such as a xenon flash tube, or hydrogen/deuterium discharge lamp or such like), which are chosen such that the dopant gas is receptive to them, and An extraction device which is arranged and designed to extract ions from the desorbed sample and transfer them into an analyzer.

All designs and details explained above in the context of the first aspect of the disclosure are also applicable to the second aspect, if expedient and technically feasible.

According to a third aspect, the disclosure relates to a method to generate ions from a deposited sample, comprising: Keeping the deposited sample in a conditioned environment which comprises a dopant gas, Desorbing the deposited sample using an energy burst, Ionizing particles in the desorbed sample by irradiating them with coherent electromagnetic waves or through the action of an electric discharge, a plasma or (possibly pulsed) light of an arc discharge lamp with intensive photon emission (with a broadband emission spectrum), where the coherent electromagnetic waves, the electric discharge, the plasma, or the light of the arc discharge lamp, are chosen such that the dopant gas is receptive to them, and Extracting ions from the desorbed sample and transferring the ions into an analyzer.

The method is preferably carried out with a device as explained above, if this is expedient and technically feasible.

Mass spectrometric analytical methods are generally very expensive. This applies not least to instruments for laser mass spectrometry (for MALDI-2 MSI, two systems from the manufacturers Spectroglyph and Bruker will soon be commercially available). With the system presented, the performance data of these platforms can be significantly improved yet again, without the need for large financial investment. The system can be easily and inexpensively retrofitted to all platforms known to date. Biomedical research projects can thus generate significantly more comprehensive results, while the time needed for the measurements stays almost the same, which means that previously unnoticed effects can be detected and used for less specific comparative studies.

BRIEF DESCRIPTION OF THE DRAWINGS

The invention can be better understood by referring to the following illustrations. The elements in the illustrations are not necessarily to scale, but are primarily intended to illustrate the principles of the invention (mostly schematically). The same reference numbers designate the same elements in the various diagrams.

DETAILED DESCRIPTION

While the invention has been illustrated and explained with reference to a number of embodiments thereof, those skilled in the art will recognize that various changes in form and detail can be made without departing from the scope of the technical teaching, as defined in the attached claims.

The invention increases the yields of molecular ions in mass spectrometry (especially in laser mass spectrometry such as MALDI mass spectrometry; MALDI stands for matrix assisted laser desorption/ionization), mobility mass spectrometry, or combined mobility-mass spectrometry, which are low for many biomolecules—yield means the ratio of molecules that are ionized and can thus be detected by means of a mass spectrometer, and the total molecules ablated from a deposited sample.

Furthermore, matrix effects such as ion suppression effects, i.e., the suppression of specific classes of molecule by other, very easily ionized classes of molecules in the sample, are reduced.

The invention has already been successfully tested in experiments by appropriate modification of two commercially available mass spectrometers with fundamentally different operating principles.

Example 1 (Spectroglyph-Orbitrap® MS; Q Exactive Plus Orbitrap®, Thermo Fisher Scientific)

Figure 1A:
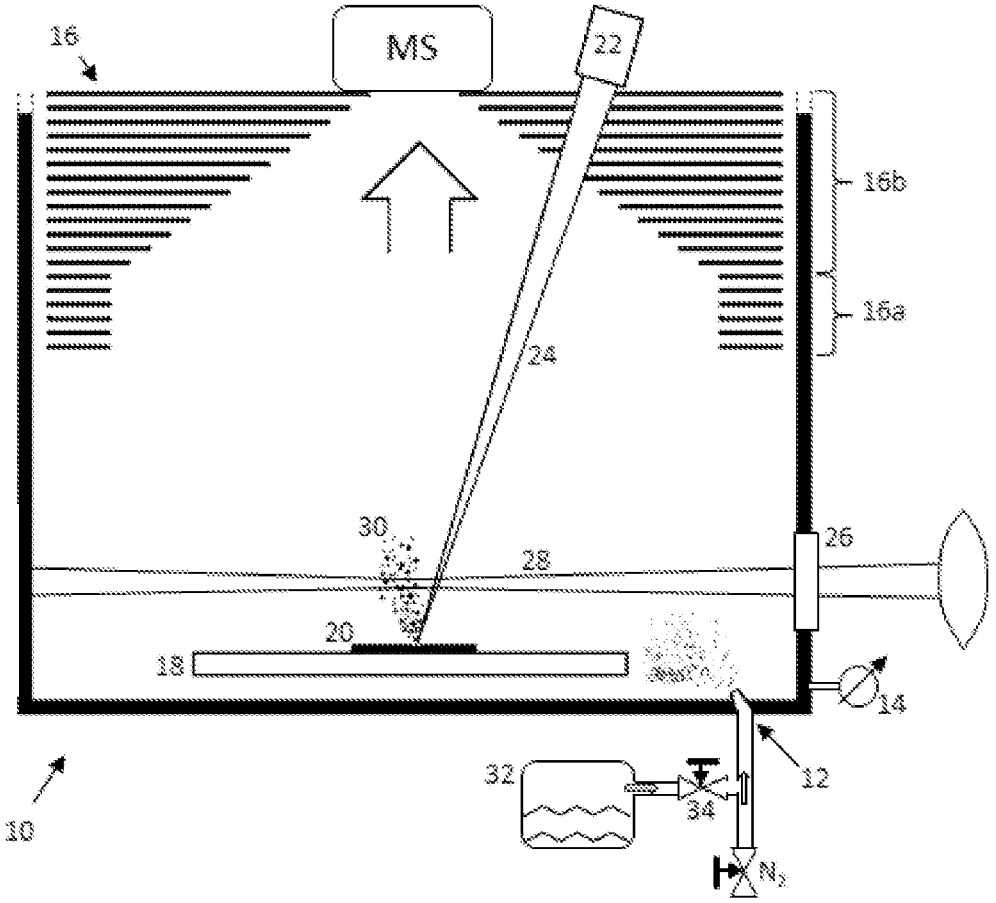
FIG. 1A shows schematically a first example embodiment of a device to generate ions from a deposited sample, comprising a chamber, desorption device, ionization device, and an extraction device.

FIG. 1A is a schematic diagram of a vacuum chamber (10), in which ions can be generated. By sealing the vacuum chamber (10) as tightly as possible, there are only two ways for gas to escape from the chamber (10): firstly via an interface to a mass analyzer (MS), via which ions and also small numbers of gas particles are fed out, and secondly via a port with a pump connected (not shown), which maintains the general pressure level in the chamber (10). In the design shown, the gas is introduced into the chamber (10) via only a single gas inlet (12), through which both molecular nitrogen as a buffer gas, which displaces residual quantities of oxygen-containing air and thus contributes to the low reactivity of the vacuum environment, as well as admixed dopant gas, such as acetone, are fed into the chamber (10). A pressure gauge (14) displays the prevailing pressure level so that the gas flows into and out of the chamber (10) can be adjusted in the event of a deviation from the desired value. Parameter range settings may include: total pressure: 2 to 20 hectopascal; partial pressure (acetone) up to 2 hectopascal.

At the interface to the mass analyzer (MS), which requires pressure levels below medium vacuum, there is an ion guide operated by an RF voltage (16), said guide consisting of a plurality of ring or apertured-plate electrodes arranged in series, some of which have a constant inside diameter and thus form a short tunnel section (16*a*), whereas the inside diameters of others taper towards the analyzer and thus form a funnel section (16*b*), which constricts ions guided through it into a quite narrow spatial region about the axis of the ion guide (16) so as to transfer them in a more compact form, and thus more efficiently, to downstream components. A DC voltage gradient from the entrance of the tunnel section (16*a*) to the exit of the funnel section (16*b*), which can be pulsed in temporal coordination with the ion generation in the chamber (10), if necessary, drives the ions forward to feed them out of the chamber (10).

A translation device (18), on which there is a mass spectrometric specimen slide (20), is located in the lower section of FIG. 1A. An ablation laser (22) is positioned in the upper section of FIG. 1A and aligned such that its pulsed beam (24) can be guided through separate apertures (not shown) in the ring electrodes in the funnel section (16*b*) of the ion guide and impinge on the specimen slide (20) at a predetermined location. The translation device (18), e.g., a vacuum-compatible x/y translation stage with low mechanical abrasion, can move the specimen slide (20) that sits on it in two spatial directions in the plane that is almost perpendicular to the ablation laser beam (24), and can thus bring different points of the surface into the focus of the ablation laser (22) each time, as is systematically done for example when scanning a tissue section or a regular arrangement of individual preparations, e.g., on AnchorChip™ plates.

A transparent window (26) is built into the side wall of the chamber (10), through which a post-ionization laser pulse (28) can be beamed laterally into the chamber (10) and focused at a position directly above the specimen slide (20) so as to interact with the desorbed neutral molecules (30) created by the desorption of the deposited sample and with the dopant gas, which is omnipresent in the background. A beam dump (not shown) can be mounted on the opposite side wall of the chamber (10) to prevent damage to the chamber wall and undesired scattered photons.

The dopant gas, e.g., acetone, is removed from the headspace in a container (32) over the surface of the liquid ("headspace method"), and introduced into the vacuum chamber (10) at around 3 to 15 hectopascal via a separate feed-in. The dopant gas feed and the total source pressure with molecular nitrogen $N_2$ as buffer gas can be manually controlled by a needle valve (34). The sample can be a porcine brain homogenate, for example, coated with the MALDI matrix substance 2,5-dihydroxyacetophenone (DHAP) according to standard protocol and ablated with the standard Nd:YLF laser (wavelength 349 nanometers). The post-ionization can be achieved by means of a frequency-quadrupled Nd:YAG laser (wavelength 266 nanometers, Ekspla, at 28 picosecond pulse duration). In both the positive and the negative ion mode, significant signal increases can be demonstrated for a large number of biochemically relevant analytes, for example various glycerophospholipids.

Figure 1B:
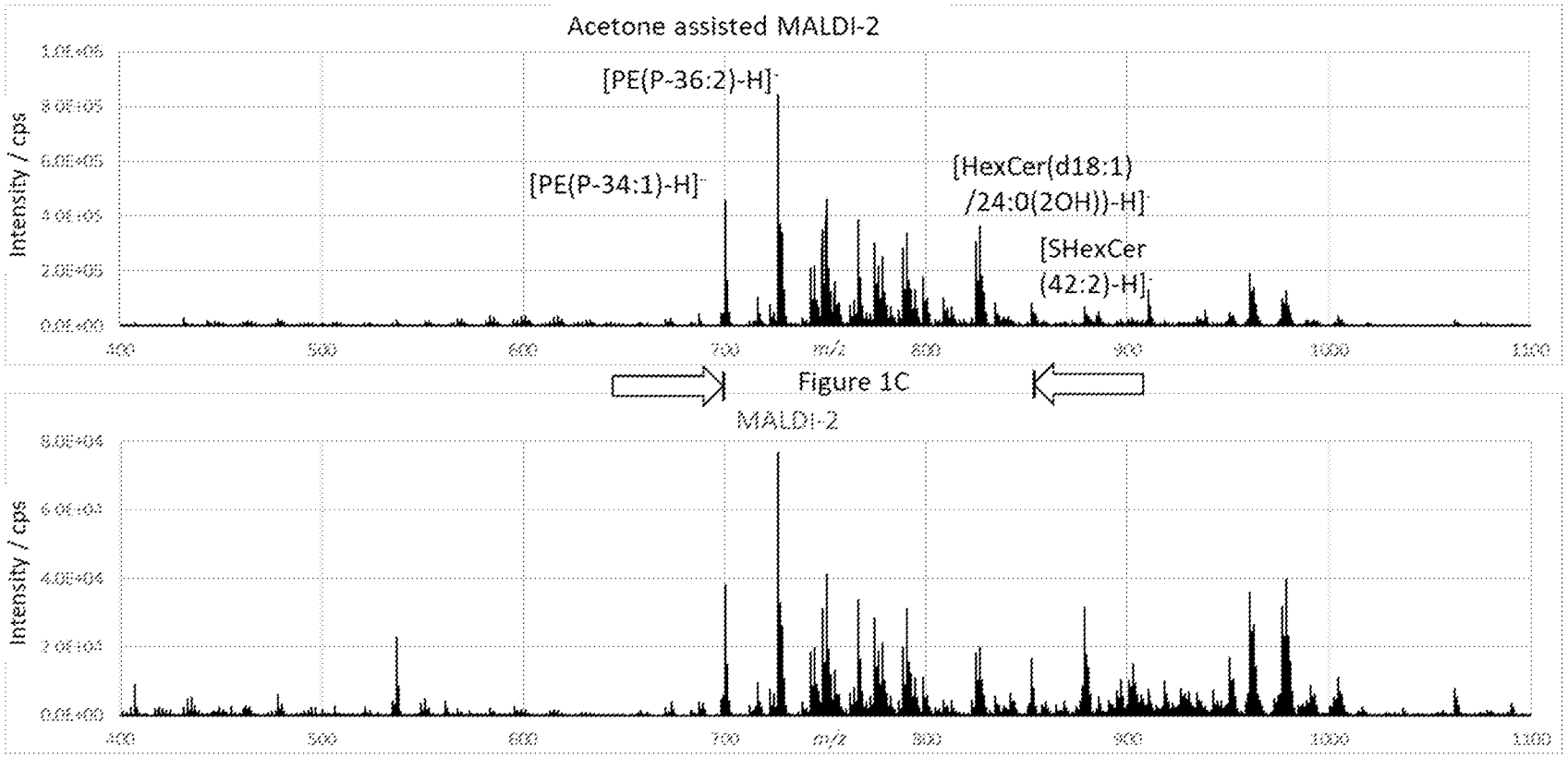
FIG. 1B illustrates measurement results of the improved detection sensitivity, which were obtained with a Spectroglyph-Orbitrap®-MS; Q Exactive Plus Orbitrap®, Thermo Fisher Scientific (Bremen, Germany).
Figure 1C:
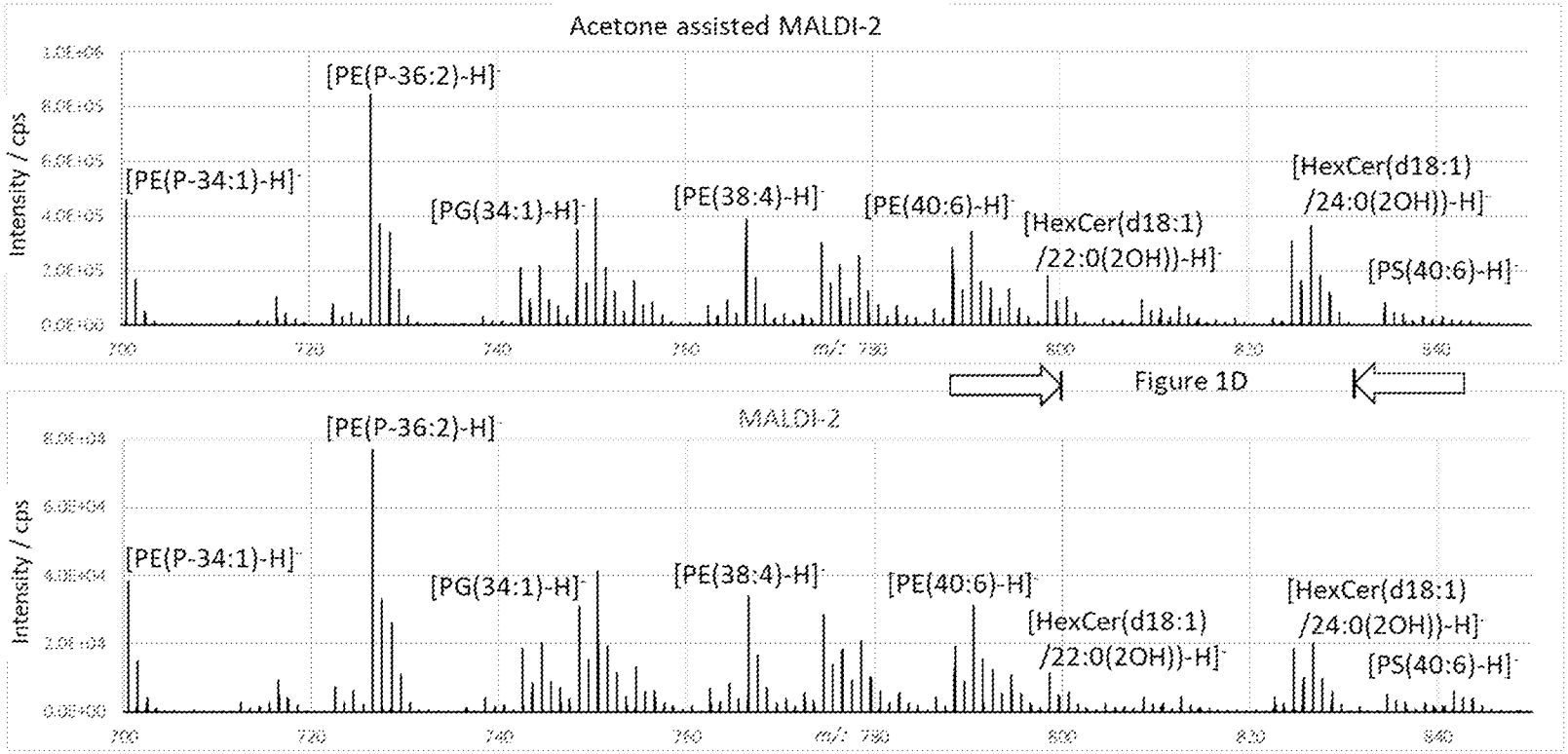
FIG. 1C further illustrates measurement results of the improved detection sensitivity, which were obtained with a Spectroglyph-Orbitrap®-MS; Q Exactive Plus Orbitrap®, Thermo Fisher Scientific (Bremen, Germany).
Figure 1D:
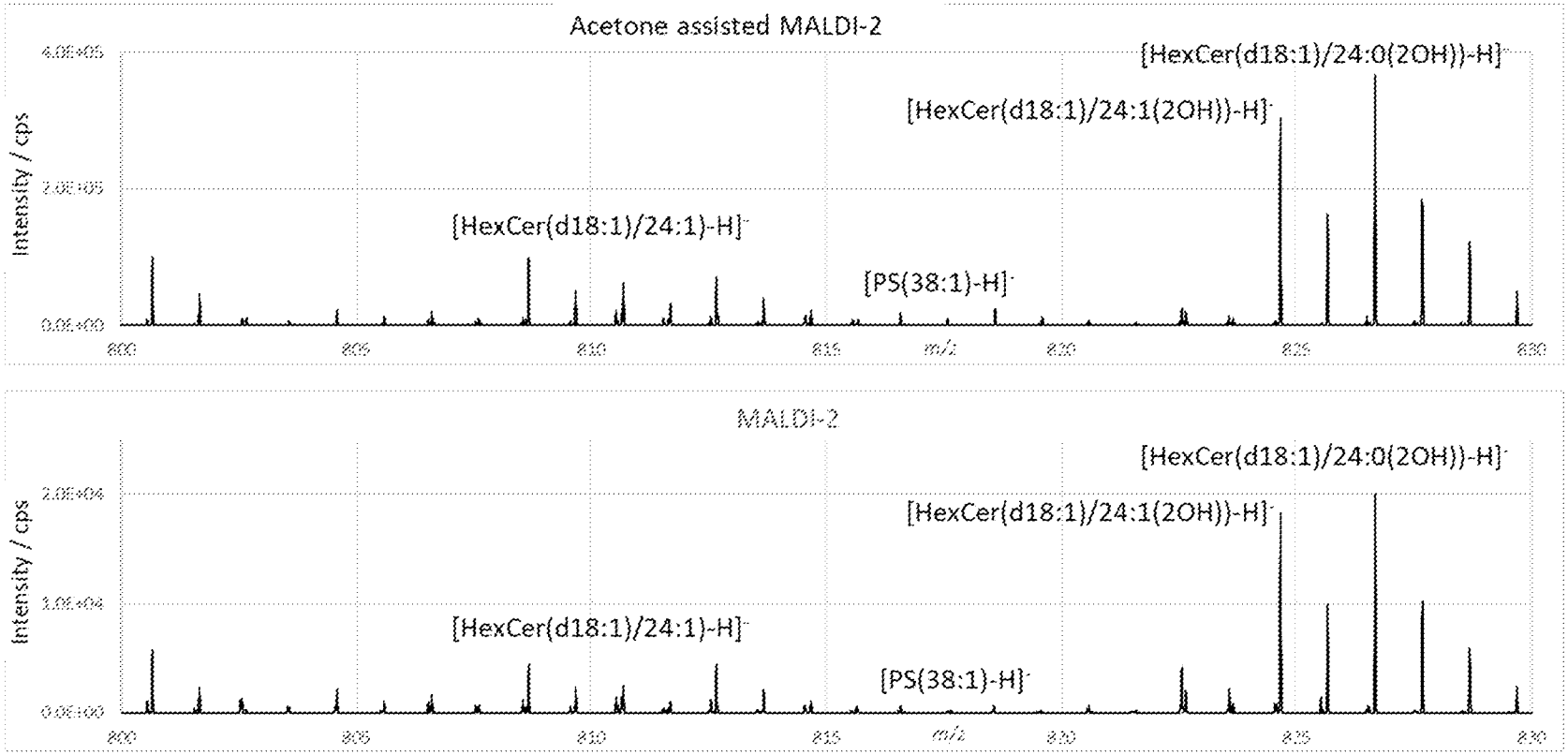
FIG. 1D yet further illustrates measurement results of the improved detection sensitivity, which were obtained with a Spectroglyph-Orbitrap®-MS; Q Exactive Plus Orbitrap®, Thermo Fisher Scientific (Bremen, Germany).

FIGS. 1B, 1C, and 1D illustrate spectra of a thin section of the same porcine brain homogenate preparation, which was coated with the matrix substance DHAP. The measurement was conducted with a Spectroglyph-Orbitrap® coupling, as outlined in FIG. 1A, under optimized conditions in each case in the positive ion mode (MALDI-2) using the dopant gas acetone (upper diagram in each case) and without dopant gas for comparison (lower diagram in each case). As can be seen from the various mass range sections m/z in the spectra, the intensity of the mass signals increases by around one order of magnitude (factor×10), whereas the signature or profile of the mass signals remains more or less constant. The increase in sensitivity is therefore also achieved across a broad mass range.

Example 2 (Quadrupole Time-Of-Flight MS; Synapt G2-S, Waters Corporation)

Figure 2:
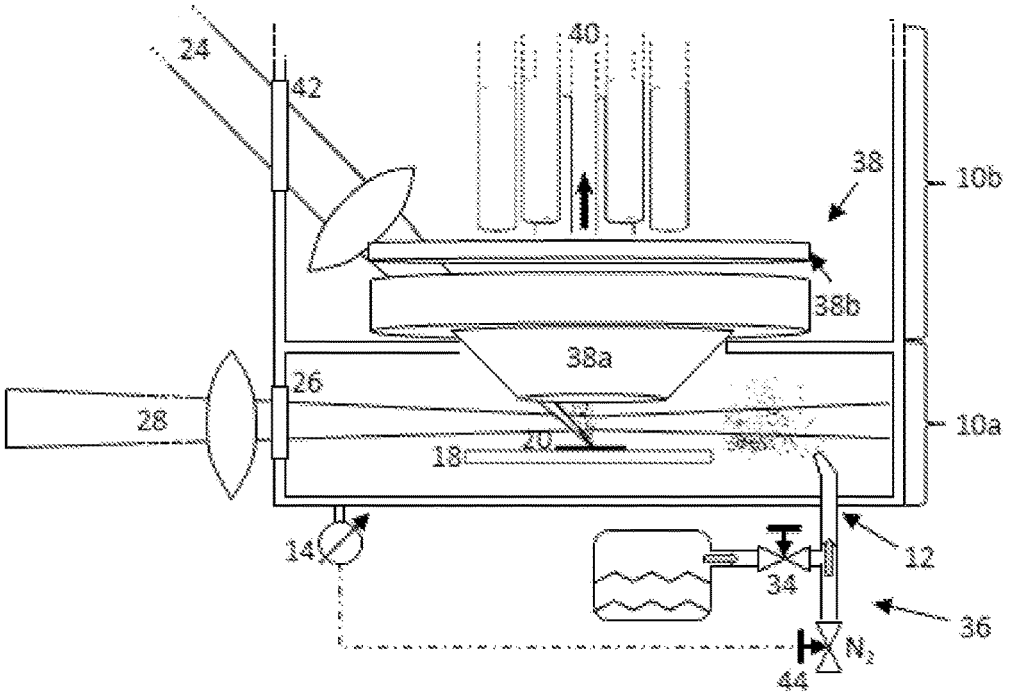
FIG. 2 shows schematically a second example embodiment of a device to generate ions from a deposited sample, comprising a modified chamber, desorption device, ionization device, and modified extraction device.

FIG. 2 is a schematic diagram of a two-part vacuum chamber (10*a*, 10*b*), in whose lower part (10*a*) ions can be generated. By sealing the vacuum chamber (10*a*, 10*b*) as tightly as possible, there are only two ways for gas to escape from the chamber (10*a*, 10*b*): firstly via an interface to a time-of-flight analyzer (not shown), via which ions and also gas particles are fed out, and secondly via a port with a pump connected (not shown), which maintains the general pressure level in the chamber (10*a*, 10*b*). In the design shown, the gas is introduced into the chamber (10*a*, 10*b*) via only a single gas inlet (12), through which both molecular nitrogen as a buffer gas, which displaces residual quantities of oxygen-containing air and thus contributes to the low reactivity of the vacuum environment, as well as admixed dopant gas, such as acetone, are fed into the lower part of the chamber (10*a*). A pressure gauge (14) monitors the pressure level set by the operator and communicates with a gas feed device (36) so that the buffer gas flow into and out of the lower part of the chamber (10*a*) can be automatically adjusted in the event of a deviation from the desired value. Parameter range settings may include: total pressure: 0.2 to 4 hectopascal; partial pressure (acetone) up to 2 hectopascal.

An arrangement of voltage-controlled extraction electrodes (38) is located at the interface to the vacuum region of the time-of-flight analyzer, which requires a pressure level lower than medium vacuum (the boundary between the lower and the upper part of the chamber). An extraction electrode (38*a*) with a conical opening extends into both parts of the chamber (10*a*, 10*b*) and its truncated end is located opposite a sample desorption region in the lower part of the chamber (10*a*). Further annular extraction electrodes (38*b*) in the upper part of the chamber (10*b*) lead to an RF multipole ion guide (40) in a hexapole design, which can guide ions into further connected components of the time-of-flight analyzer. A DC voltage gradient from the truncated conical electrode (38*a*) to the hexapole (40), which can be pulsed in temporal coordination with the ion generation in the lower part of the chamber (10*a*), if necessary, drives the ions forward in order to feed them out of the lower part of the chamber (10*a*).

A translation device (18), on which there is a mass spectrometric specimen slide (20), is located in the lower part of the chamber (10*a*). An ablation laser is positioned in the top left section of FIG. 2 outside the upper part of the vacuum chamber (10*b*) and aligned such that its pulsed beam (24) is directed through a transparent window (42) of the vacuum system and through separate apertures (not shown) in the arrangement of annular extraction electrodes (38*b*), and impinges on the specimen slide (20) at a predetermined location at a distinct angle to the surface normal. The translation device (18), e.g., a vacuum compatible x/y translation stage with low mechanical abrasion, can move the specimen slide (20) that sits on it in two spatial directions in the plane that is perpendicular to the alignment of the arrangement of extraction electrodes (38) and the hexapole (40), and can thus bring different points of the surface into the focus of the ablation laser each time, as is systematically done for example when scanning a tissue section or an array of individual preparations, e.g., on AnchorChip™ plates.

A transparent window (26) is built into the side wall of the lower part of the chamber (10*a*), through which a post-ionization laser pulse (28) can be beamed laterally into the lower part of the chamber (10*a*), and focused at a position directly above the specimen slide (20) so as to interact with the desorbed neutral molecules created by the desorption of the deposited sample and with the dopant gas, which is omnipresent in the background. A beam dump (not shown) can be mounted on the opposite side wall of the lower part of the chamber (10) to prevent damage to the chamber wall and undesired scattered photons.

The dopant gas, such as acetone, is introduced into the lower part of the vacuum chamber (10*a*) via the central buffer gas inlet (12) at around 0.5 to 4 hectopascal, using the headspace method. The dopant gas feed is manually controlled via a needle valve (34); the total source pressure is automated via pneumatic valves (44) and controlled in communication with the pressure gauge (14). As an example of a sample, a porcine brain homogenate can be coated with 2,5-DHAP matrix, according to standard protocol, and ablated with the standard Nd:YLF laser (wavelength 349 nanometers). The post-ionization is achieved by a frequency-quadrupled Nd:YAG laser (wavelength 266 nanometers, Ekspla, at 28 picosecond pulse duration). In both the positive and the negative ion mode, significant signal increases can be demonstrated for a large number of biochemically relevant analytes, for example various glycerophospholipids.

Figure 3:
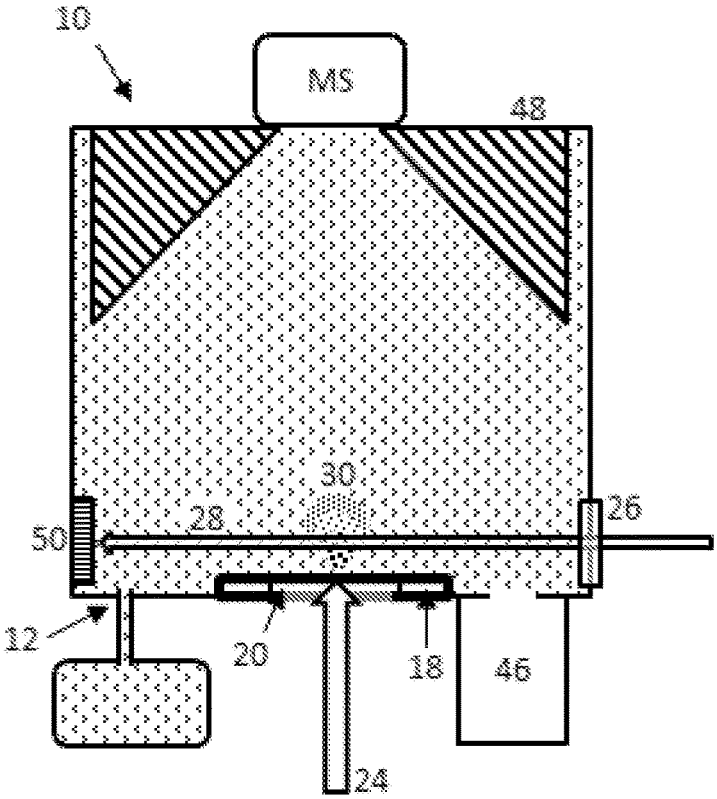
FIG. 3 shows schematically a third example embodiment of a device to generate ions from a deposited sample, comprising a chamber, modified desorption device, ionization device, and an extraction device.

FIG. 3 is a schematic diagram of a chamber (10) in which ions can be generated. A conditioned environment is maintained by ensuring the chamber (10) is sealed as tightly as possible. There are fundamentally only two ways for gas to escape from the chamber (10): firstly—following a pressure gradient—via an interface to a mass analyzer (MS), a mobility analyzer, or a combined mobility-mass analyzer, through which ions and also gas particles are fed out, and secondly via a port with a connected pump (46), which maintains the general pressure level in the chamber (10) in coordination with the gas supply for the conditioned environment. In the design shown, gas is fed into the chamber (10) via only a single gas inlet (12), through which both a low-reactivity buffer gas, which displaces residual quantities of oxygen-containing air and thus contributes to the low reactivity of the conditioned environment, as well as admixed dopant gas are fed into the chamber (10). A pressure gauge (not shown) monitors the pressure level set by the operator so that the gas flows into and out of the chamber (10) can be adjusted in the event of a deviation from the desired value, possibly automatically in direct communication with valves of the gas inlet (12). The chamber (10) can essentially be operated at or close to atmospheric pressure, or in a medium vacuum, depending on the equilibrium of the gas inflows and outflows into and out of the chamber (10).

A voltage-assisted extraction device (48) comprising several electrodes (not shown) is located at the interface to the analyzer, which usually requires pressure levels below medium vacuum, e.g., a high vacuum (>$10^{-3}$ hectopascal). A DC voltage gradient across the extraction device (48), which can be pulsed in temporal coordination with the ion generation in the chamber (10), if necessary, drives the ions forward in order to feed them out of the chamber (10).

A translation device (18) with a recess into which a mass spectrometric specimen slide (20) is placed, is located in the lower section of FIG. 3. With an appropriately transparent design of the chamber floor and the specimen slide (20), a pulsed ablation laser beam (24) can act in transmission at a predetermined location on the deposited sample through the specimen slide (20), and desorb the sample, e.g., by means of transmission MALDI (t-MALDI). The translation device (18), e.g., a vacuum compatible x/y translation stage with low mechanical abrasion, where appropriate, can move the specimen slide (20) located in the recess in two spatial directions along the floor of the chamber in the plane that is almost perpendicular to the ablation laser beam (24), and can thus bring different points of the surface into the focus of the ablation laser each time, as is systematically done for example when scanning a tissue section or an arrangement of individual preparations. A UV-transmitting glass plate, as used in microscopy, can be used as the specimen slide (20), for example. The surface of the glass plate which bears the sample can be designed so as to be conductive, e.g., by means of a coating.

A transparent window (26) is built into the side wall of the chamber (10), through which a post-ionization laser pulse (28) can be beamed laterally into the chamber (10) and focused at a position directly above the specimen slide (20) so as to interact with the desorbed neutral molecules (30) created by the desorption of the deposited sample and with the dopant gas, which is omnipresent in the background. In contrast to the designs explained previously, where the energy burst is effected by beams (24) which impinge at an angle on the sample side, the neutral molecules are desorbed to a large extent along the normal to the surface on the sample side because the impact is frontal from the rear surface. A beam dump (50) is mounted on the opposite side wall of the chamber (10) to prevent damage to the chamber wall and undesired scattered photons.

The dopant gas, which is fed into the chamber as a continuous flow or in pulses, and is thus omnipresent, e.g., a polar aprotic solvent such as acetone, anisole, and chlorobenzene, a polar protic solvent such as isopropanol, a nonpolar solvent such as toluene, or a mixture of the aforementioned, assists in the post-ionization of the sample desorbed by bombardment with the pulsed transmission laser beam (24) directly above the specimen slide (20) by increasing the number of locally available charge carriers, in particular by photochemical excitation of the neutral dopant gas molecules and subsequent transfer of charge carriers, e.g., protons, to desorbed neutral sample molecules.

A common feature of all the embodiments explained above is that material is desorbed spatially resolved from a sample (prepared with matrix, if necessary) with the aid of an energy burst from a primary energy source, e.g., an ablation laser (for example by LDI/MALDI). A secondary post-ionization laser, which emits coherent electromagnetic waves, is focused into the desorption cloud produced, which drastically increases the ion yield (e.g., by MALDI-2).

In addition, a dopant, which is volatile under the chosen pressure conditions and which is receptive to the coherent electromagnetic waves (e.g., acetone, toluene, anisole, chlorobenzene, isopropanol), is now fed permanently (or in pulses) from a reservoir into the gaseous phase. The feed-in can be effected by pressure gradients from the headspace over the surface of the liquid of a bottle (or other container) filled with the liquid dopant, or by means of injection, directly into the conditioned environment of the ion source. Furthermore, the volatile dopant can be fed into the ion source through a separate gas pipe (Orbitrape®) or by a gas mixer with a mass flow control via the gas pipe of the $N_2$ buffer gas (Synapt).

The gaseous phase portion of the dopant gas can be regulated by means of a fine adjustment valve (manually with a needle valve or by means of electrically controlled valves) and the pressure controlled via pressure gauges. By regulating the buffer gas (in the case of the Synapt, example 2: automated), the optimal dopant gas partial pressure and total source pressure can be set and kept sufficiently constant over several hours. A secondary energy source (e.g., in the form of a plasma, an electric discharge, an arc discharge lamp with broadband emission spectrum or, in the examples shown, a post-ionization laser) excites the omnipresent dopant gas in the gaseous phase, which enables effective post-ionization of the desorbed material of the sample.

Further embodiments of the invention are conceivable in addition to the embodiments described by way of example. With knowledge of this disclosure, those skilled in the art can easily design further advantageous embodiments, which are to be covered by the scope of protection of the appended claims, including any equivalents as the case may be.

The invention claimed is:

1. A device to generate ions from a deposited sample, comprising:

a chamber which is arranged and designed to keep the deposited sample in a conditioned environment, where the conditioned environment comprises a dopant gas, a desorption device which is arranged and designed to desorb the deposited sample in the chamber using an energy burst, an ionization device which, for the purpose of ionization, is arranged and designed to irradiate the desorbed sample in the chamber using coherent electromagnetic waves which are chosen such that the dopant gas is receptive to them, and an extraction device which is arranged and designed to extract ions from the desorbed sample and transfer them into an analyzer.

2. The device according to claim 1, wherein the dopant gas is selected from the groups: (i) polar aprotic solvents such as acetone, anisole, and chlorobenzene, (ii) polar protic solvents such as isopropanol, and/or (iii) non-polar solvents such as toluene.

3. The device according to claim 1, wherein the chamber has a feed-in device which is arranged and designed to feed in a gas with low reactivity as buffer gas for the conditioned environment.

4. The device according to claim 3, wherein the feed-in device is arranged and designed to admix the dopant gas to the buffer gas.

5. The device according to claim 1, wherein the chamber is connected to a vacuum source to evacuate the environment of the deposited sample.

6. The device according to claim 5, wherein the vacuum source is arranged and designed to maintain a pressure which is substantially higher than a high vacuum ($>10^{-3}$ hectopascal) and lower than around $10^2$ hectopascal.

7. The device according to claim 1, wherein the desorption device is arranged and designed to direct an energetic beam onto the deposited sample to trigger the energy burst.

8. The device according to claim 7, wherein the energetic beam is a pulsed laser beam to ablate the deposited sample.

9. The device according to claim 7, wherein the energetic beam and the coherent electromagnetic waves are not aligned in parallel, but have directions of propagation which are at an angle to each other.

10. The device according to claim 1, wherein the coherent electromagnetic waves have a wavelength longer than around 140 nanometers.

11. The device according to claim 1, wherein the ionization device is arranged and designed to irradiate the desorbed sample with a pulse of coherent electromagnetic waves tempo-rally coordinated with the energy burst.

12. A device to generate ions from a deposited sample, comprising:

a chamber which is arranged and designed to keep the deposited sample in a conditioned environment, where the conditioned environment comprises a dopant gas, a desorption device which is arranged and designed to desorb the deposited sample in the chamber using an energy burst, an ionization device which, for the purpose of ionization, is arranged and designed to expose the desorbed sample in the chamber to an electric discharge, a plasma, or light of an arc discharge lamp with broadband emission spectrum, which are chosen such that the dopant gas is receptive to them, and an extraction device which is arranged and designed to extract ions from the desorbed sample and transfer them into an analyzer.

13. A method to generate ions from a deposited sample, comprising:

keeping the deposited sample in a conditioned environment, which comprises a dopant gas, desorbing the deposited sample using an energy burst, ionizing particles in the desorbed sample by exciting molecules of the dopant gas and providing a charge carrier transfer between the dopant gas molecules and the particles in the desorbed sample, and extracting ions from the desorbed sample and transferring the ions into an analyzer.

14. The method according to claim 13, wherein the dopant gas molecules are excited using coherent electromagnetic waves.

15. The method according to claim 13, wherein the dopant gas molecules are excited by an electric discharge, a plasma or light of an arc discharge lamp with broadband emission spectrum.

16. The method according to claim 13 wherein said charge carrier transfer is a transfer from the dopant molecules to the particles in the desorbed sample.

* * * * *